US005933162A

United States Patent [19]

Shioya

[11] Patent Number: 5,933,162

[45] **Date of Patent: *Aug. 3, 1999**

[54] INK JET APPARATUS AND INK JET METHOD

[75] Inventor: Makoto Shioya, Tokyo, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/220,053

[22] Filed: Mar. 30, 1994

[30] Foreign Application Priority Data

Mar. 31, 1993 [JP] Japan ..... 5-73841

[51] Int. Cl.[6] ..... B41J 2/145; B41J 2/15; B41J 29/38

[52] U.S. Cl. ..... 347/40; 347/5

[58] Field of Search ..... 347/40, 41, 15, 347/98, 43, 5, 14

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,721,968 | 1/1988 | Arai et al. | 346/136 |
| 4,723,129 | 2/1988 | Endo et al. | 347/56 |
| 4,740,796 | 4/1988 | Endo et al. | 347/56 |

FOREIGN PATENT DOCUMENTS

| | | | |
|---|---|---|---|
| 0376596 | 7/1990 | European Pat. Off. . | |
| 0517521 | 12/1992 | European Pat. Off. . | |
| 517519 | 12/1992 | European Pat. Off. | B41J 2/205 |
| 54-56847 | 5/1979 | Japan . | |
| 59-123670 | 7/1984 | Japan . | |
| 59-138461 | 8/1984 | Japan . | |
| 60-71260 | 4/1985 | Japan . | |
| 4-358847 | 6/1991 | Japan | B41J 2/205 |
| 4-358847 | 12/1992 | Japan . | |

*Primary Examiner*—N. Le
*Assistant Examiner*—Thinh Nguyen
*Attorney, Agent, or Firm*—Fitzpatrick, Cella, Harper & Scinto

[57] ABSTRACT

In the case that one pixel is recorded with a maximum number of three dots, each dot is recorded by performing different scanning operations. At this time, the recording paper is conveyed in the forward direction for a certain period of time between the first scanning operation and the second scanning operation, causing ink to be ejected from different ejection orifices during each scanning operation. With respect to the assignment for allowing each dot to be recorded on the recording paper during which scanning operation, a first scanning operation is assigned to a third dot without fail. Thus, the number of dots to be recorded during the first preceding scanning operation is larger than the number of dots to be recorded during the subsequent scanning operation.

21 Claims, 8 Drawing Sheets

IMAGE DATA FOR PRINTING
⊙:PIXEL FORMED WITH THREE DOTS
◎:PIXEL FORMED WITH TWO DOTS
○:PIXEL FORMED WITH ONE DOT

ASSIGNMENT TO EACH SCANNING
1: FIRST SCANNING
2: SECOND SCANNING

DOTS FORMED IN FIRST SCANNING

DOTS FORMED IN SECOND SCANNING

IMAGE DATA FOR PRINTING: 1 1 1 4 4 5 5

5: PIXEL FORMED WITH FIVE DOTS
4: PIXEL FORMED WITH FOUR DOTS
3: PIXEL FORMED WITH THREE DOTS
2: PIXEL FORMED WITH TWO DOTS
1: PIXEL FORMED WITH ONE DOT

| ASSIGNMENT TO EACH SCANNING | 1 | 2 | 3 | 1 | 2 | 2 | 3 |
|---|---|---|---|---|---|---|---|
| 1: FIRST SCANNING | | | | 2 | 3 | 3 | 1 |
| 2: SECOND SCANNING | | | | 3 | 1 | 1 | 2 |
| 3: THIRD SCANNING | | | | 1 | 1 | 1 | 1 |
| | | | | | | 2 | 2 |

| | | | | | | | |
|---|---|---|---|---|---|---|---|
| 1: DOTS FORMED IN FIRST SCANNING | ○ | | | ◎ | ◎ | ◎ | ◎ |
| 2: DOTS FORMED IN SECOND SCANNING | | ○ | | ○ | ○ | ◎ | ◎ |
| 3: DOTS FORMED IN THIRD SCANNING | | | ○ | ○ | ○ | ○ | ○ |

FIG.8A

IMAGE DATA FOR PRINTING: 1 1 1 4 4 5 5

5: PIXEL FORMED WITH FIVE DOTS
4: PIXEL FORMED WITH FOUR DOTS
3: PIXEL FORMED WITH THREE DOTS
2: PIXEL FORMED WITH TWO DOTS
1: PIXEL FORMED WITH ONE DOT

| ASSIGNMENT TO EACH SCANNING | 1 | 2 | 3 | 1 | 2 | 3 | 3 |
|---|---|---|---|---|---|---|---|
| 1: FIRST SCANNING | | | | 2 | 3 | 1 | 1 |
| 2: SECOND SCANNING | | | | 3 | 1 | 2 | 2 |
| 3: THIRD SCANNING | | | | 1 | 2 | 1 | 1 |
| | | | | | | 2 | 2 |

| | | | | | | | |
|---|---|---|---|---|---|---|---|
| 1: DOTS FORMED IN FIRST SCANNING | ○ | | | ◎ | ○ | ◎ | ◎ |
| 2: DOTS FORMED IN SECOND SCANNING | | ○ | | ○ | ◎ | ◎ | ◎ |
| 3: DOTS FORMED IN THIRD SCANNING | | | ○ | ○ | ○ | ○ | ○ |

FIG.8B

INK JET APPARATUS AND INK JET METHOD

BACKGROUND OF THE INVENTION

1. Field of the Invention

The present invention relates to an ink jet apparatus adapted to achieve a printing operation in a multi-gray scale mode by performing scanning operations by several times with the aid of an ink jet head having a plurality of ink ejection orifices formed thereon. Further, the present invention relates to an ink jet method to be practiced by operating an ink jet apparatus of the foregoing type.

It should be noted that the ink jet apparatus and the ink jet method to which the present invention has been applied should not be limited only to an ink jet apparatus and an ink jet method both of which are employable for recording characters, images or the like on a paper. Alternatively, the present invention may equally be applied to an ink jet apparatus and an ink jet method both of which are employable for ejecting ink to a cloth or a various medium and fixing thereto (hereinafter referred to widely as printing).

2. Description of the Prior Art

There have been hitherto known various kinds of methods each capable of expressing a gray scale of each image or the like in accordance with an ink jet system.

The conventional methods as mentioned above are exemplified by a method of changing an area of each pixel by changing a size of each ink droplet ejected from an ink ejection orifice (Area gray scale method), a method of expressing a gray scale by changing the number of dots on the assumption that an assembly of dots formed with ejected ink droplets is counted as one pixel (Density pattern method, Dither method or the like), a method of performing a recording operation using inks each having a different density of color (Different density method), and a method of expressing a gray scale by changing an area of each dot or a density of color of the dot depending on the number of ink droplets shot onto a recording medium on the assumption that one dot is formed by shooting a plurality of ink droplets onto the recording medium (multi-droplet method). A term "shot" means that ink for forming a pixel is ejected to the pixel. Among the aforementioned conventional methods, the multi-droplet method is expected as a method of enabling each recording operation or each printing operation to be performed at a high speed while expressing a high resolution and a great many gray levels.

However, since the conventional multi-droplet system is practiced such that a single pixel is formed with ink droplets ejected from a same ejection orifice, in the case that the direction of ejecting a series of ink droplets and a quantity of each ejected ink fluctuate (variation) from ejection orifice to ejection orifice, there arise problems that stripes (bandings) appear on an image to be originally uniform in structure, and moreover, a shade of color varies. Specifically, when the ink droplet flying direction fluctuates, the position of each dot formed on a recording paper is dislocated from a predetermined one, resulting in stripes undesirably appearing on a recorded image. In addition, when a volume of each ejected ink droplet fluctuates, a size of each dot formed on the recording paper and density of color of the same fluctuate, resulting in the shade of color of each image formed on the recording paper undesirably fluctuating.

To prevent the aforementioned problems from arising, the conventional multi-drop system requires that an ink jet head is produced at a very high accuracy in order to suppress fluctuation of the ink droplet ejecting direction and fluctuation of an ink droplet ejecting volume between adjacent ejection orifices as far as possible. However, this leads to another problems that the ink jet head is produced at an expensive cost and a yielding rate associated with the production of the ink jet head is degraded.

There is exemplified a method of solving a problem of fluctuation of a shade of color by employing a suitable software. This method is achieved by changing the number of ink droplets to be shot onto a recording medium in such a manner as to eliminate a difference between adjacent ejection orifices in a quantity of ink to be ejected therefrom. However, when the exemplified method is practically employed for an ink jet recording system, there arises a problem that the whole system is produced at an increased cost. In addition, the employment of the foregoing method is not effective for solving a problem of appearance of stripes or bands on a recorded image. In the case that fluctuation between adjacent ejection orifices in a quantity of ink to be ejected therefrom varies as time elapses, it is necessary to readjust the number of ink droplets to be shot onto the recording medium. This leads to another problem that a quality of maintenance service to be rendered for the ink jet apparatus is undesirably degraded.

To solve the foregoing problem, the assignee to the present invention already proposed a multi-gray level recording method such that a pixel is formed with a plurality of ink droplets which are ejected from different orifices from each other so that fluctuation between pixels in a quantity of ejected ink can be reduced and moreover, bands and shade irregularity visually recognizable on a recorded image is appeared with much difficulties as disclosed in Japanese Patent Application Laying-open No. 4-358847 (U.S. Ser. No. 07/893,086).

FIG. 1 is an illustrative view which schematically shows an outline of the proposed method.

Specifically, when this method is practiced for an ink jet apparatus, an image is recorded on a recording medium by performing scanning operations by several times, and at the same time, respective dots constituting a line extending in the scanning direction are formed with a plurality of ink droplets ejected from different ejection orifices during the several scanning operations. For example, in the case that a plurality of black-colored pixels each represented by a mark of ● are recorded on the recording medium, dots each constituting a pixel are formed with ink droplets are ejected from three different ejection orifices from each other, fluctuation of the respective ink droplets in the ejecting direction can be averaged so that any visual recognition of stripes do not appear on a recorded image. In the case that it is assumed that fluctuation of a quantity of each ejected ink droplet among ejection orifices is normally distributed with a standard deviation $\sigma$, when the proposed method is employed for the recording apparatus, fluctuation of a quantity of ejected ink between adjacent lines is reduced to a level of $\sigma/\sqrt{3}$. Since the fluctuation of a quantity of each ejected ink droplet between adjacent lines is visually recognized as fluctuation of a pixel density, an image having less shade irregularity can be obtained with the recording apparatus.

However, for example, with respect to the case exemplified in FIG. 1, there arises a problem that a recording speed of the recording apparatus is reduced because the number of scanning operations performed for the purpose of recording is tripled.

To cope with this problem, there is proposed a method of reducing the number of scanning operations to be performed for the same purpose and ejecting a plurality of ink droplets from a single ejection orifice per one scanning operation.

FIG. 2 is an illustrative view which show an example of the foregoing proposed method. FIG. 2 shows the case that one pixel is recorded on the recording medium during two scanning operations.

Specifically, in the case that three ink droplets are required per one pixel, two ink droplets during one scanning operation are combined with one ink droplet during one scanning operation, in the case that two ink droplets are required per one pixel, one ink droplet is ejected from one ejection orifice during one scanning operation and scanning operations are performed by two times, and in the case that one ink droplet is required per one pixel, a recording operation is achieved during either of two scanning operations.

When this method is employed for the recording apparatus, scanning operations are performed by two times per one pixel. Thus, this method has an advantage that a recording speed can be increased compared with the aforementioned conventional method. However, in contrast with this conventional method wherein scanning operations are performed by three times to form one pixel, the foregoing method has problems that an extent of eliminating the malfunctions of appearance of stripes and shade irregularity visually recognizable on a recorded image is appreciably insufficient, and moreover, when three ink droplets are shot onto the recording medium, ink is liable to overflow on the recording medium due to a large quantity of ink to be shot onto the latter per a unit time.

With respect to one of the aforementioned problems, i.e., appearance of stripes and shade irregularity visually recognizable on the recorded image, on the assumption that the standard deviation of fluctuation of a quantity of ink ejected from the ejection orifices is designated by $\sigma$, the fluctuation of a quantity of ejected ink from line to line is represented by $\sigma/\sqrt{2}$ (in the case that one pixel is formed during one scanning operation). Since this fluctuation is not largely different from $\sigma/\sqrt{3}$ (in the case that one pixel is formed during three scanning operations), there are many cases that the foregoing fluctuation is allowable.

On the other hand, with respect to the other problem that ink overflow is liable to occur on the recording medium, a malfunction of comparatively significant image deterioration (hereinafter referred to as bleeding), i.e., a malfunction of formation of an indistinct recorded image of which corners are vaguely recognized is liable to arise especially in the case that each recording operation is performed using a recording medium having poor ink absorption properties or in the case that two kinds of inks each having a different color are mixed with each other to form an indistinct image.

SUMMARY OF THE INVENTION

An object of the present invention is to provide an ink jet apparatus which assures that a clear image can be recorded or printed on a medium without any remarkable reduction of a recording or printing speed while exhibiting few fluctuation of stripes, few fluctuation of a shade of color and few bleeding.

Another object of the present invention is to provide an ink jet method to be practiced with the aid of an ink jet apparatus of the foregoing type.

In the first aspect of the present invention, an ink jet apparatus using an ink jet head having a plurality of ejection portions formed thereon, the ink jet head serving to eject ink from the ejection portions toward an ejection medium during a scanning operation of the ink jet head, the apparatus comprises;

a printing controlling means for forming one line composed of a number of pixels arranged in the scanning direction with the ink droplets ejected from at least two different ejection portions from each other among the plurality of ejection portions during each of the scanning operations of the ink jet head by two times or more, in which the printing controlling means is constructed such that when it is assumed that a number of scanning operations required for forming the one line is k ($k \geqq 2$), a number of ink droplets to be shot onto one of the pixels is m, and a maximum value of m representing a number of ink in a whole area of an image to be printed is g, an inequality of $k<g$ is established, and in the case that a pixel defined by an inequality of $k<m$ is formed, an extra quantity of ink droplets represented by a residue of m/k are sequentially shot during the preceding scanning operations.

In the second aspect of the present invention, an ink jet apparatus using an ink jet head having a plurality of ejection portions formed thereon, the ink jet head serving to eject ink from the ejection portions toward an ejection medium during a scanning operation of the ink jet head, the apparatus comprises;

a printing controlling means for forming one line composed of a number of pixels arranged in the scanning direction with the ink droplets ejected from at least two different ejection portions from each other among the plurality of ejection portions during each of the scanning operations of the ink jet head by two times or more, in which the printing controlling means is constructed such that when each pixel is formed, ink is shot in conformity with a relationship preliminarily determined between a number of ink droplets to be shot and the scanning operation associated with the shooting of the ink droplets, and the relationship is determined such that the number of ink droplets to be shot is larger as the scanning operation is performed at more preceding time.

In the third aspect of the present invention, an ink jet apparatus using an ink jet head having a plurality of ejection portions formed thereon, the ink jet head serving to eject ink from the ejection portions toward an ejection medium during a scanning operation of the ink jet head, the apparatus comprises;

a printing controlling means for forming one line composed of a number of pixels arranged in the scanning direction with the ink droplets ejected from at least two different ejection portions from each other among the plurality of ejection portions during each of the scanning operations of the ink jet head by two times or more, in which the printing controlling means is constructed such that when it is assumed that a number of scanning operations required for forming one line is k ($k \geqq 2$), a number of ink droplets to he shot onto one of the pixels is m, and a maximum value of m representing a number of ink droplets in a whole area of an image to be printed is g, an inequality of $k<g$ is established, and in the case that a pixel defined by an equation of $m=g$ is formed, an extra quantity of ink droplets represented by a residue of g/k are sequentially shot during the preceding scanning operations.

In the fourth aspect of the present invention, an ink jet apparatus using an ink jet head having a plurality of ejection portions formed thereon, the ink jet head serving to eject ink from the ejection portions toward an ejection medium during a scanning operation of the ink jet head, the apparatus comprises;

a printing controlling means for forming one line composed of a number of pixels arranged in the scanning direction with the ink droplets ejected from at least two different ejection portions from each other among the plurality of ejection portions during each of the scanning operations of the ink jet head by two times or more, in which the print controlling means is constructed such that when it is assumed that a number of scanning operations required for forming the one line is k ($k \geqq 2$), a number of ink droplets to be shot onto one of the pixels is m, and a maximum value of m representing a number of ink droplets in a whole area of an image to be printed is g, an inequality of $k<g$ is established, in the case that pixels defined by an inequality of $k<m<g$ are formed, an extra quantity of ink droplets represented by a residue of m/k are shot during the scanning operations determined corresponding to the scanning operation for ejecting the ink droplets other than the extra quantity of ink droplets, and in the case that pixels defined by an equation of $m=g$ are formed, an extra quantity of ink droplets defined by the residue of g/k are sequentially shot during the preceding scanning operations.

In th fifth aspect of the present invention, an ink jet method of ejecting ink toward an ejecting medium from an ink jet head having a plurality of ejection portions formed thereon, comprises the steps of;

ejecting ink droplets from the ejection portions different from each other with a certain time difference kept between successive ejected ink droplets, and forming a predetermined number of pixels with the ejected ink droplets, in which a number of ink droplets precedently ejected from the ejection portions of the ink jet head is larger than that of ink droplets subsequently ejected from the same.

In the sixth aspect of the present invention, an ink jet method comprises the steps of;

preparing an ink jet head having a plurality of ejection portions formed thereon, repeatedly scanning the ink jet head relative to an ejecting medium by plural times, and ejecting ink from the ink jet head during each scanning operation by several times, in which a number of ink ejections executed during a preceding scanning operation in the repeatedly scanned region is larger than a number of ink ejections executed during subsequent scanning operation.

The results obtained from a variety of examination works conducted by the inventor reveal that a malfunction of ink overflow arising on a printing medium can adequately be controlled by properly adjusting the time when each ink droplet is shot onto the printing medium.

For example, in the case that three ink droplets per one pixel are shot onto the printing medium during two scanning operations on the assumption that one ink droplet is shot from one ejection orifice per one ink ejection, when two ink droplets are shot during the preceding scanning operation and one ink droplet is shot during the subsequent scanning operation, few ink overflow is visually recognized on the printing medium compared with the case that one ink droplet is shot during the preceding scanning operation and two ink droplets are shot during a subsequent scanning operation. This is because the ink shot during the preceding scanning operation is vaporized or it penetrates into the printing medium for a period of time that elapses until a next scanning operation is started, causing a quantity of ink remaining on the printing medium to be reduced. For this reason, also in the case that a same quantity of ink is always ejected toward the printing medium, ink is less liable to overflow on the printing medium because an effect of reducing a quantity of ink attributable to vaporization or penetration of the ink can substantially be utilized by shooting a large quantity of ink onto the printing medium during the preceding scanning operation.

In addition, the results obtained from another examination works conducted by the inventor reveal that there is a general tendency that when a quantity of ink larger than that of ink to be shot onto the printing medium during the subsequent scanning operation is shot onto the printing medium during the preceding scanning operation, few ink is liable to overflow on the recording medium, an image of which edges are clearly visually recognized can be obtained, and moreover, a clear colored image having different kinds of colors less mixed with each other can be obtained. Conclusively, the present invention has been made based on the aforementioned results derived from many various examination works conducted by the inventor.

In other words, according to the present invention, since the number of ink droplets to be precedently shot onto the printing medium to print a single line with the ejected ink droplets is increased, a quantity of ink to be absorbed in or vaporized from the printing medium for a period of time that elapses until subsequent ink droplets are shot onto the printing medium is increased, resulting in ink overflow being less liable to occur on the printing medium.

The above and other objects, effects, features and advantages of the present invention will become apparent from the following description of the embodiment thereof taken in conjunction with the accompanying drawings.

BRIEF DESCRIPTION OF THE DRAWINGS

FIG. 8A and FIG. 8B are illustrative views which show by way of two examples an ink jet method to be practiced according to a third embodiment of the present invention, respectively.

DESCRIPTION OF THE PREFERRED EMBODIMENTS

The present invention will now be described in detail hereinafter with reference to the accompanying drawings which illustrate a few preferred embodiments thereof.

(Embodiment 1)

Figure 3:
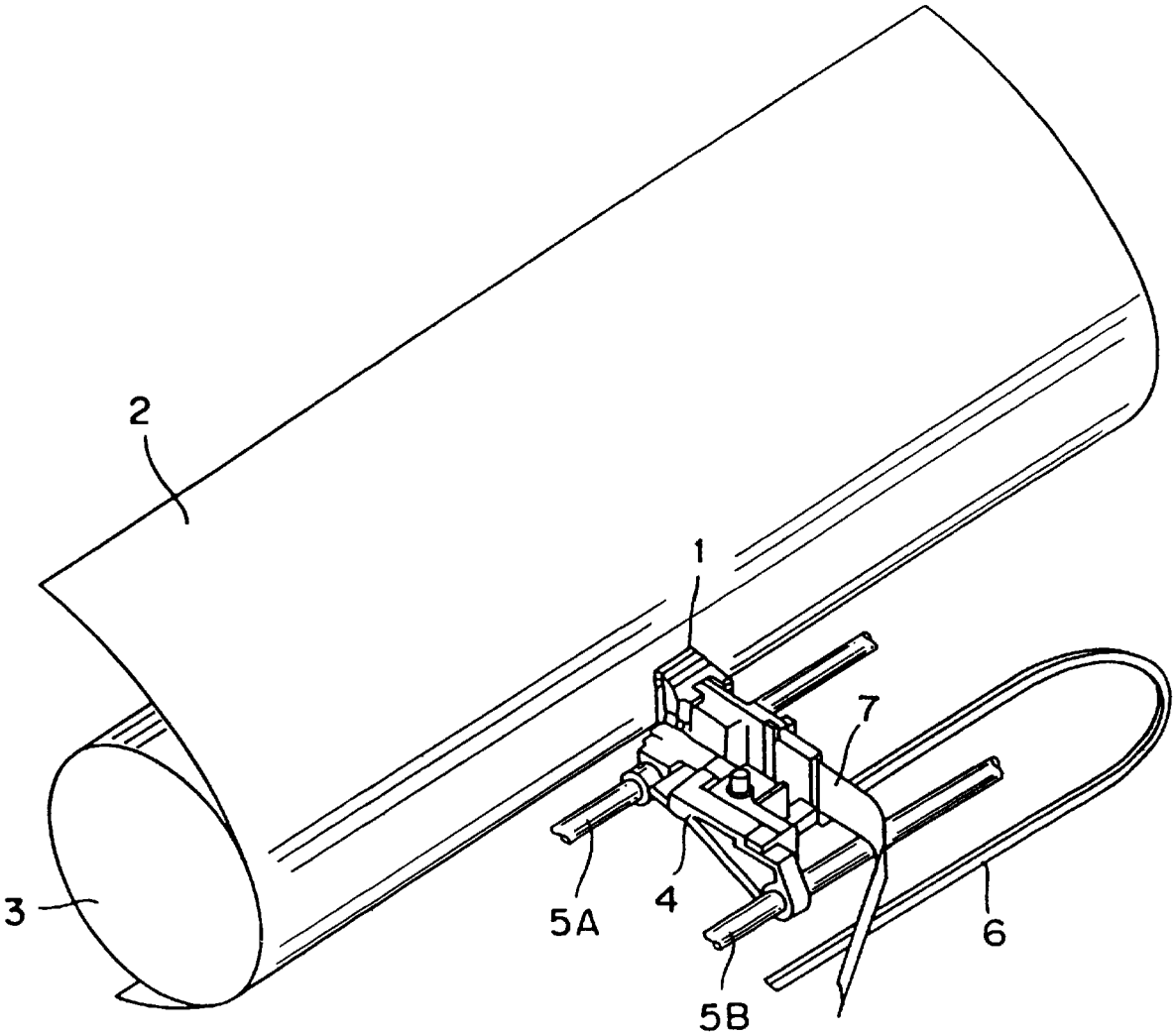
FIG. 3 is a perspective view of an ink jet apparatus constructed according to an embodiment of the present invention.
Figure 4:
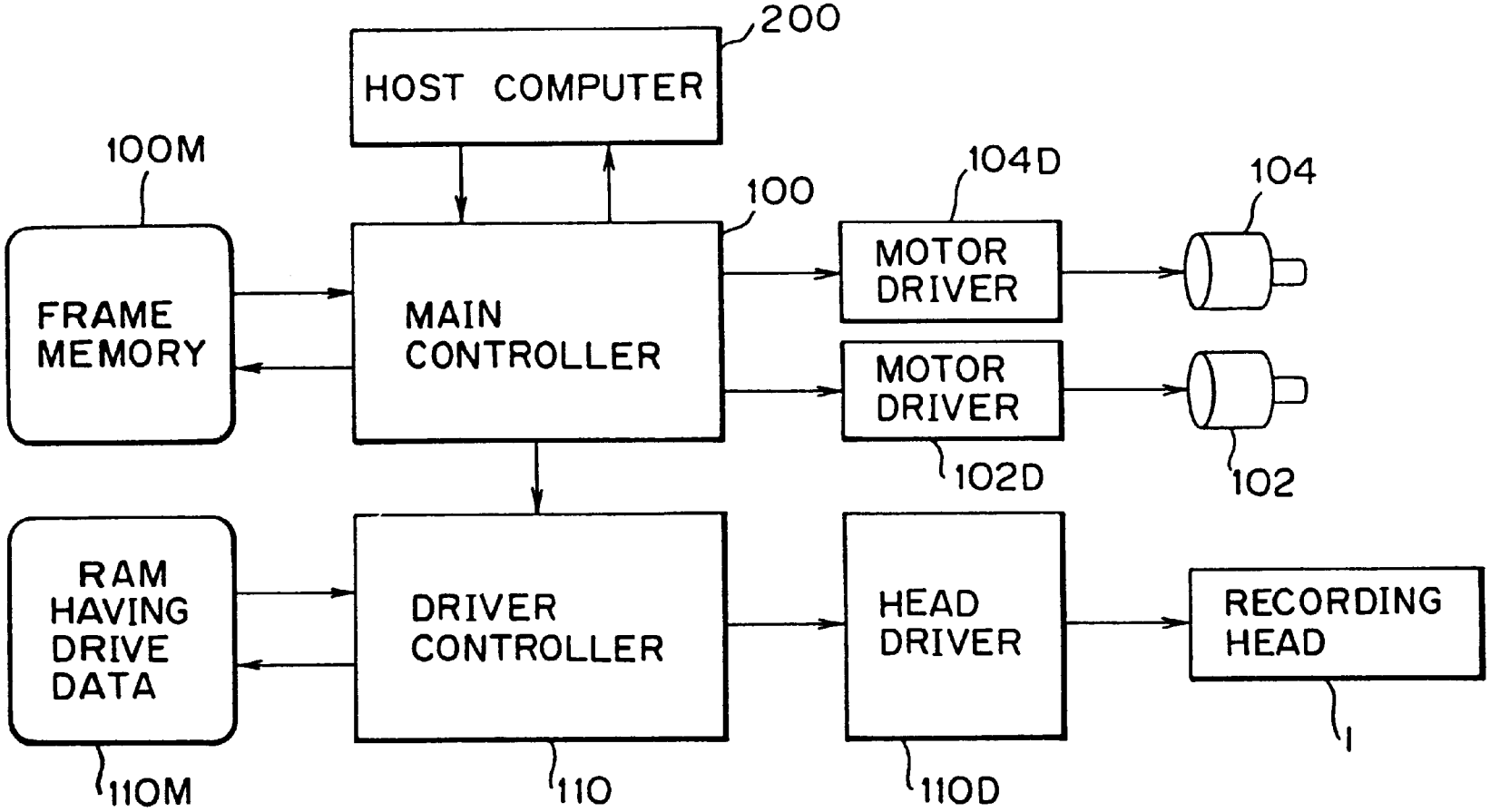
FIG. 4 is a block diagram which schematically shows the arrangement of essential control components constituting the ink jet apparatus shown in FIG. 3.

FIG. 3 is a perspective view of an ink jet recording apparatus constructed according to an embodiment of the present invention, and FIG. 4 is a block diagram which shows the structure of a controlling mechanism for the ink jet apparatus shown in FIG. 3.

In FIG. 3, reference numeral 1 designates a recording head or an ink jet head which includes sixteen ejection orifices, i.e., sixteen ejection portions at a density of 16 pieces/mm. A heater (not shown) is disposed in a flow passage which is formed in the recording head 1 and is communicated with the ejection orifice. The heater is provided for generating thermal energy to be utilized for the purpose of ejecting an ink droplet. In response to an electrical pulse applied to the heater, heat is generated from the heater, causing a phenomenon of film boiling to appear in ink. Subsequently, as a bubble is thermally expanded due to the phenomenon of film boiling, ink is ejected from each ejection orifice Reference numeral 4 designates a carriage adapted to be slidably displaced with the recording head 1 mounted thereon. The carriage 4 is slidably bridged between two guide shafts 5A and 5B extending in parallel with each other, whereby slidable displacement of the carriage 4 is properly guided by the two guide shafts 5A and 5B. Reference numeral 6 designates an ink feed tube which is used for feeding ink to the recording head 1 from an ink tank (not shown), and reference numeral 7 designates a flexible cable by way of which a driving signal or a controlling signal is transmitted to a driving circuit disposed at a part of the recording head 1 with reference to the data recorded in a controlling unit (not shown) for the ink jet apparatus. To assure that the ink feed tube 6 and the flexible cable 7 are followably displaced as the carriage 4 is slidably displaced with the aid of the guide shaft 5A and 5B, they are fabricated using different kinds of flexible materials. The carriage 4 is connected to one end of a belt (not shown) which extends in parallel with the guide shafts 5A and 5B for slidably displacing the carriage 4. Thus, as the belt is driven by a carriage motor (not shown), the carriage 4 is slidably displaced together with the recording head 1 along the guide shafts 5A and 5B.

Reference numeral 3 designates a platen roller which extends in parallel with the guide shafts 5A and 5B in the longitudinal direction thereof, and reference numeral 2 designates a recording paper which is usable as a printing medium. The recording paper 2, i.e., a sheet of recording paper is transported in the forward direction along the outer peripheral surface of the platen 3 by rotating the latter. As the carriage 4 is slidably displaced in that way, ink is ejected toward a spot on the recording paper 2 located opposite to the ejection orifices so as to enable a recording operation to be performed with the ejected ink droplet.

Referring to FIG. 4, a main controller 100 is provided in the form of a central processing unit (hereinafter referred to simply as CPU) so as to perform all controlling operations for the ink jet apparatus. In other words, the main controller 100 performs all the controlling operations by receiving various kinds of data from a host computer 200 serving as a host unit and sending the data from CPU. For example, image data transmitted from the host computer 200 are stored in a frame memory 100M by a predetermined quantity. The image data stored in the frame memory 100M are subjected to various kind of converting treatment, and thereafter, data assignment is executed as will be described later with reference to FIG. 6 and FIG. 7. Then, the image data are stored in a driving data RAM 110M as driving data for performing a recording operation while the recording head 1 is activated.

A driver controller 110 sends driving date to a head driver 110D while maintaining the timing relationship to be controlled by the main controller 100, and subsequently, the head driver 110D activates the recording head 1 based on the driving data so as to eject ink from the recording head 1.

The main controller 100 controls the driving of a motor 104 via a motor driver 104D in conformity with the ink ejection timing relationship so as to eject ink from the recording head 1, whereby as the carriage 4 (see FIG. 3) is slidably displaced so as to scan the recording head 1 with the aid of the carriage 4. In addition, the main controller 100 controls the driving of a motor 102 via a motor driver 102D so as to rotate the platen roller 3, causing the recording paper 2 to be transported in the forward direction by a predetermined quantity as will be described later every scanning operation is completed.

Figure 5:
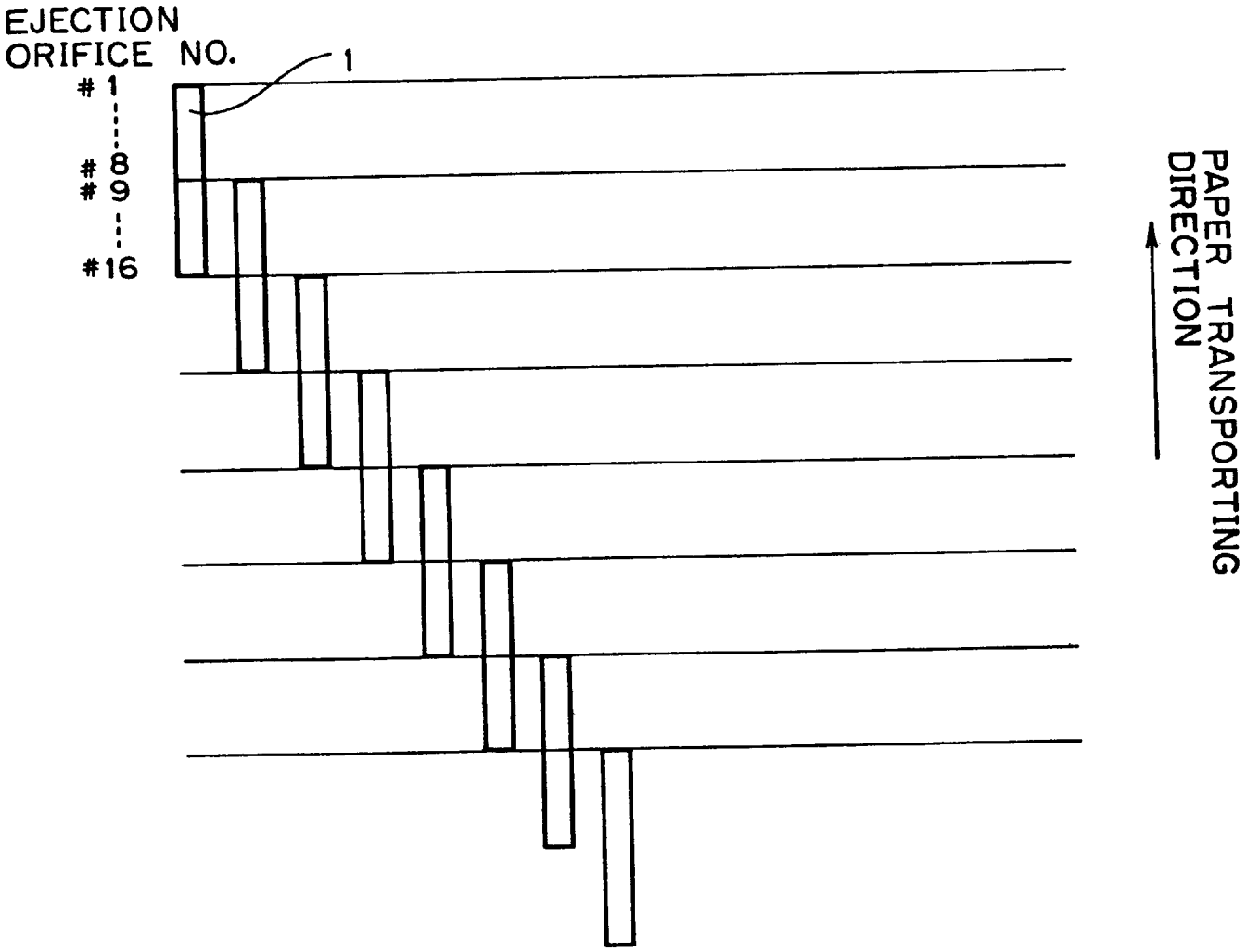
FIG. 5 is an illustrative view which schematically shows the relationship between scanning operations to be performed by a recording head for practicing an ink jet method according to the embodiment of the present invention and transportation of a recording paper.

FIG. 5 is an illustrative view which schematically shows an ink jet method to be practiced according to a first embodiment of the present invention for performing recording operations with the aid of the ink jet apparatus constructed as mentioned above.

In the drawing, reference numeral 1 schematically represents the recording head having sixteen ejection orifices arranged thereon in the vertical direction. For the convenience of explanation, the respective ejection orifices are designated by orifice numbers 1, 2, - - -, 16 from above.

Figure 1:
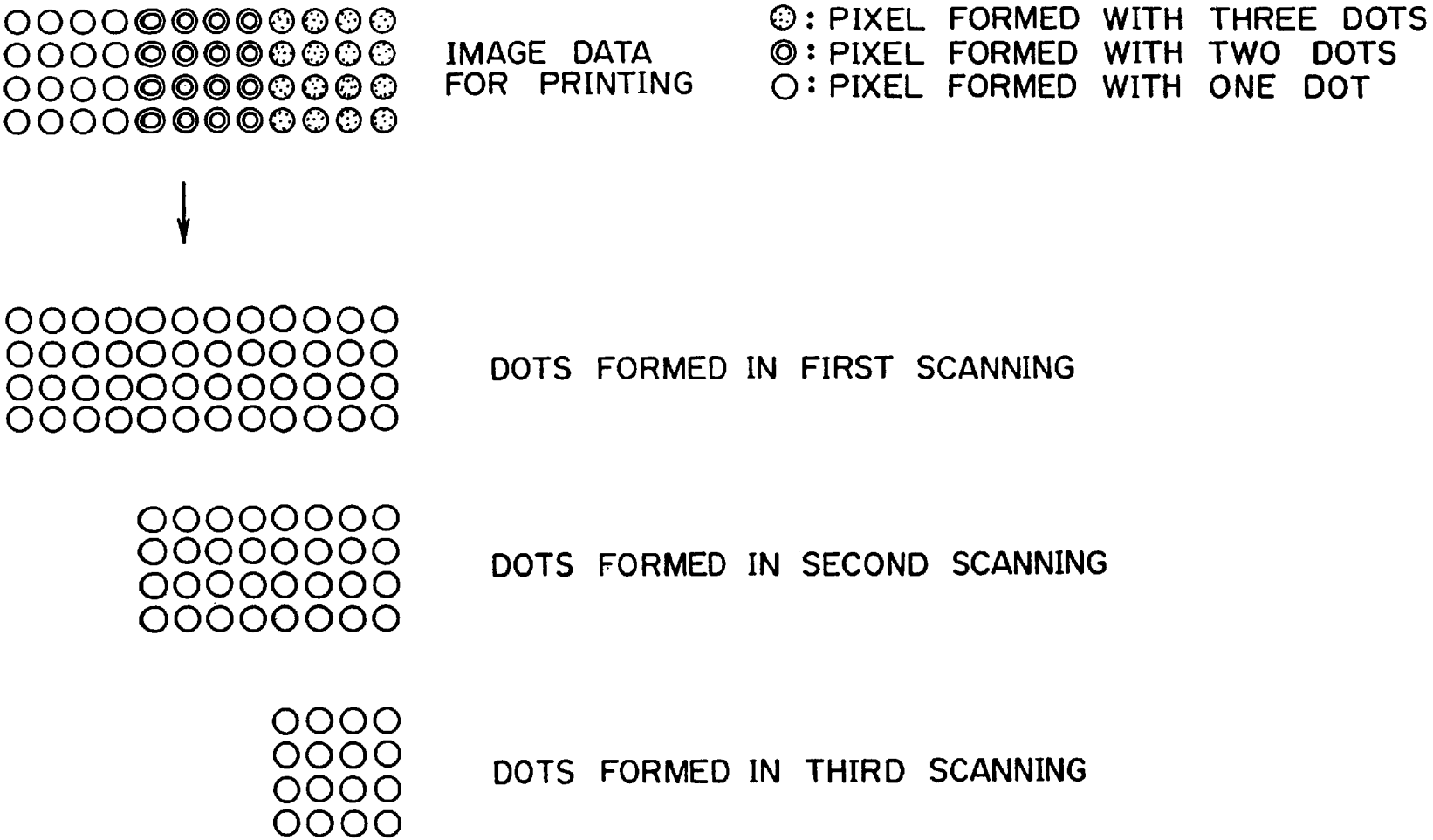
FIG. 1 (PRIOR ART)
FIG. 1 is an illustrative view which schematically shows by way of example a conventional ink jet method of recording one pixel by performing scanning operations by several time.
Figure 2:
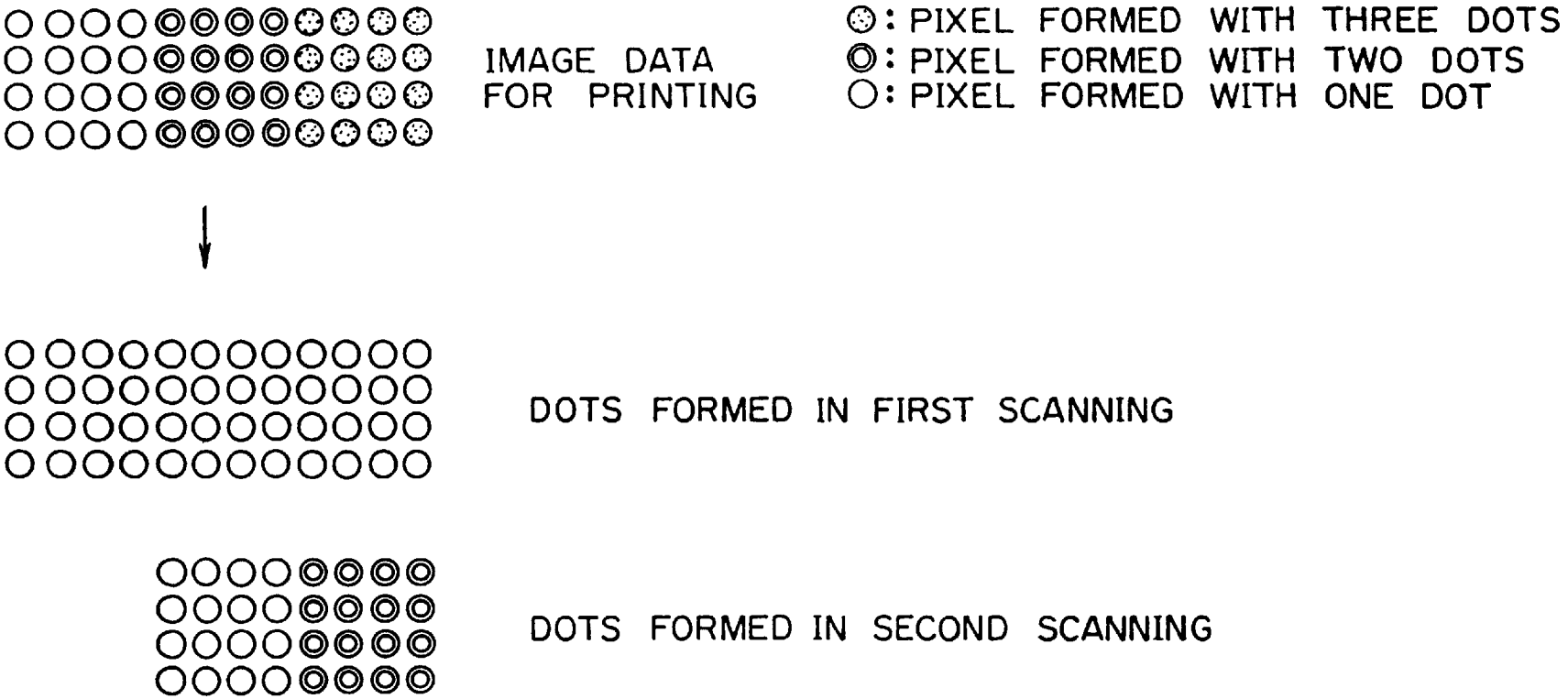
FIG. 2 (PRIOR ART)
FIG. 2 is an illustrative view which schematically shows by way of example another conventional ink jet method of the foregoing type.

When a recording operation is achieved with the recording paper 2, first, ink is ejected only from the ejection orifices designated orifices numbers 9 to 16 toward the recording paper 2 based on the image data in conformity with the ink jet method (to be described later) while slidably displacing the carriage 4 to record dots on the recording paper. Next, as shown in FIG. 5, the recording paper 2 is transported in the upward direction by a distance corresponding to eight ejection orifices, and thereafter, a recording operation is performed by using the ejection orifices designated by orifice numbers 1 to 16. Here, it should be noted that for the purpose of convenience, the recording head 1 is shown in FIG. 1 as if it is displaced in the downward direction relative to the plane of the drawing. As a result, the ejection orifices designated by orifice numbers 1 to 8 records the same image region as that recorded by the ejection orifices designated by orifice numbers 9 to 16 during the preceding scanning operation. At this time, the ejection orifices designated by orifice numbers 9 to 16 are used to record a new image region. Next, the recording paper 2 is transported in the upward direction again by a distance corresponding to eight ejection orifices to perform a recording operation using the ejection orifices designated by orifice numbers 1 to 16. Thus, the whole surface of the recording paper 2 is recorded with the ejected ink by sequentially repeating recording operations as mentioned above. Incidentally, the lowermost end of the recording paper is recorded to form an image end without any ink ejection from the ejection orifices designated by orifice numbers 9 to 16.

Next, description will be made with respect to an ink jet method to he practiced for performing a recording operation with the aid of the aforementioned ink jet apparatus while maintaining a gray scale number 4 (which represents that one pixel is formed at a single location on the recording paper 2 by shooting a maximum number of three ink droplets).

Figure 6:
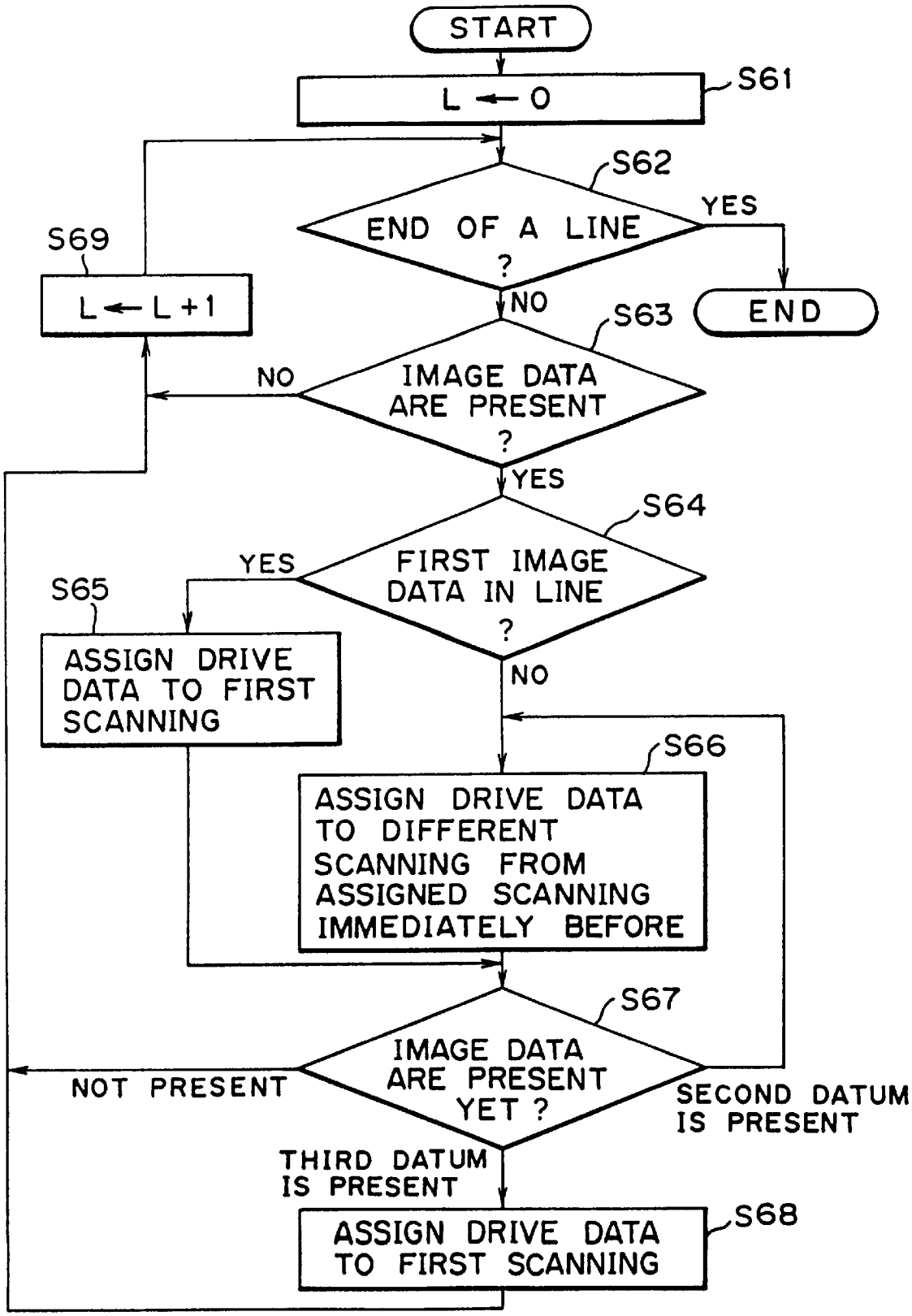
FIG. 6 a flowchart which shows a procedure of controlling operations to be performed by practicing the ink jet method according to a first embodiment of the present invention.

FIG. 6 is a flowchart which schematically shows a procedure of controlling operations to be executed for data assignment based on the image data having a maximum gray level number 4 by practicing the ink jet method according to the first embodiment of the present invention.

Figure 7A:
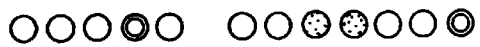
FIG. 7A, FIG. 7B and FIG. 7C are illustrative views which show image data, a process of assigning each scanning operation and results derived from scanning operations performed by practicing an ink jet method according to the first embodiment of the present invention, respectively.
Figure 7B:
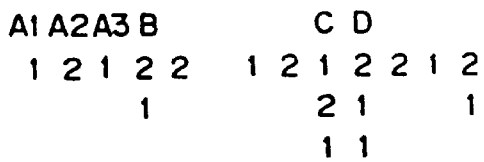
Figure 7C:
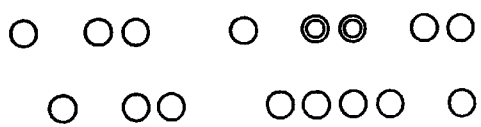

FIG. 7A, FIG. 7B and FIG. 7C are illustrative views which show a procedure of data assigning according to the first embodiment each scanning operation.

In this embodiment, as shown in FIG. 7B, driving data to be recorded (hereinafter referred to simply as a dot) are sequentially assigned to two scanning operations.

When assignment treatment is started by employing the ink jet method according to the first embodiment of the present invention, first, the content of a register L(not shown) adapted to show that the driving data are data which represent what numbered pixel in a certain line is initialized (Step S61 in FIG. 6). Subsequently, the main controller 100 determines based on the content of the register L whether this pixel is a last pixel in the foregoing line or not (Step S62). In the case that this pixel is not a pixel located at the terminal end of the line, the main controller 100 determines whether the image data representing this pixel are present or not (i.e., whether this pixel is formed on the recording paper 2 or not) (Step S63). In the case that the image data are present, the main controller 100 determines whether or not they represent a first recorded image visually recognizable in this line, i.e., whether or not this recorded image is a pixel which is first formed in this line (Step S64). In the case that the image data are first data, a first dot is assigned to a first scanning operation as shown by reference character A1 in FIG. 7B (Step S65).

In the case that the image data are not a first dot in the foregoing line, dots, as shown by reference characters A2, A3, C and D in FIG. 7B, are assigned to a scanning operation different from the last scanning operation to which a last assigning dot in a pixel located directly before is assigned (Step S66).

In the case that the number of droplets to be shot onto the foregoing pixel is two and data having no assignment executed thereto are present, a dot to be secondly assigned is assigned to a scanning operation different from that for the first dot as shown by reference character B in FIG. 7B (step S66, Step S67).

In addition, in the case that the number of droplets to be shot onto the foregoing pixel is three, dot to be secondly assigned is assigned to a scanning operation different from that for the first assigned dot as shown by reference characters C and D in FIG. 7B (Step S66, Step S67), and third dot is assigned to a first scanning operation as shown by reference characters C and D in FIG. 7B (Step S66 and Step S68).

Assignment to each scanning operation based on image data corresponding each line is executed by repeating the aforementioned procedure so as to perform a recording operation with the recording apparatus.

To assure that a series of treatments as mentioned above are generalized, a measure is usually taken in the following manner. Specifically, on the assumption that the number of scannings required for forming one line is designated by k, the number of ink droplets to be shot onto one pixel is designated by m and a maximum value of the numeral m is designated by g, when an inequality of $m>k$ is established in the case that an inequality of $k<g$ is established, an extra number of ink droplets corresponding to a residue of m/k are sequentially shot onto the recording paper during the preceding scanning operation but when an inequality of $m \leqq k$ is established, a scanning operation different from the scanning operation performed directly before the foregoing one is assigned. In addition, a scanning operation to be firstly assigned for forming a pixel is performed in a different manner from the scanning operation lastly assigned for forming the pixel directly before the foregoing one.

Since a single line is formed in conformity with the aforementioned assignment by using different ejection orifices, appearance of stripes and shade irregularity on a recorded image can be reduced. In addition, a quantity of ink consumed during the preceding scanning operation when three ink droplets are shot onto a single pixel is increased without fail. For example, with respect to pixels designated by reference characters B, C and D in FIG. 7B, the number of numeral "1" is larger than that of numeral "2". Consequently, a clear image having few bleeding can be obtained based on the aforementioned assignment.

When assignment treatment is executed in the above-described manner, a first dot in each line is assigned to a first scanning operation (Step S65). However, the present invention should not be limited only to this. It is obvious that the first dot may be assigned to a second scanning operation.

In this embodiment, since the frequency of usage of the ejection orifices through which ink is ejected during the first scanning operation is high, a problem is liable to appear in respect of reduction of stripes and shade irregularity on a recorded image as well as durability of each ejection orifice. To avoid the appearance of the foregoing problem, a measure may be taken such that the scanning assignment as mentioned above with reference to Step S67, S66 or S67 is executed only in the boundary between adjacent dots each having a difference color where a malfunction of bleeding arises, and moreover, scanning assignment can be executed for a third dot in a different manner from that for a second dot also in the case that the number of dots to be shot is three with the same color employed for the respective dots.

(Embodiment 2)

In this embodiment, scanning assignment is executed based on items shown in the following table while using the same recording apparatus as that in Embodiment 1.

TABLE 1

| number of ink droplets to be shot | scanning assignment |
|---|---|
| 3 | two ink droplets during first scanning and one ink droplet during second scanning |
| 2 | one ink droplet during first scanning and one ink droplet during second scanning |
| 1 | one ink droplet during second scanning |
| 0 | |

In the case that the number of dot to be recorded on the recording paper is one, it is acceptable that the dot is recorded on the recording paper during a first scanning operation. To assure that the frequency of usage of the ejection orifices is uniformalized as far as possible, it is preferable that the recording of each dot is assigned to a second scanning operation.

In contrast with the preceding embodiment, in this embodiment, an algorism for scanning assignment can be simplified. This leads to an advantageous effect that each recording operation can be achieved with simple circuits arranged in the recording apparatus. In the case that the number of dot to be recorded on the recording paper is one, the ejected ink droplet is recorded on the recording paper during a single scanning operation (i.e., it is ejected from a same ejecting orifice). Thus, there a rise problems that stripes and shape irregularity are readily visually recognized on a recorded image and a quality of each recorded image is liable to fluctuate.

(Embodiment 3)

In this embodiment, a recording operation is performed with the same recording apparatus as that in Embodiment 1 under the some conditions as those in Embodiment 1 with the exception that an ink jet head of the recording apparatus includes sixty ejection orifices, the number of scanning operations to be performed for forming a plurality of dots in a single line is three, and a gray scale number is set to six (i.e., a maximum number of five ink droplets per one pixel are shot onto the recording paper).

FIG. 8A and FIG. 8B are illustrative views which show an ink jet method process of assigning each dot to three scanning operations based on image data according to a third embodiment of the present invention, respectively.

A plurality of dots to be recorded on the recording paper to form a single line are sequentially assigned to two scanning operations to be performed in the main scanning direction in the same manner as the first embodiment of the present invention. In other words, each assignment is executed in conformity with rules as noted below.

1) A first dot located in the foregoing line is assigned to a first scanning operation in the same manner as the first embodiment of the present invention.

2) Assignment of each pixel is executed such that a scanning operation different from the scanning operation for a dot finally assigned of a pixel located directly before the foregoing pixel is assigned to a dot of later pixel.

3) In the case that the number of dots to be shot onto each pixel is two or three, scanning operations each different from a scanning operation to be performed for a first dot are sequentially assigned to second and third dots.

4) In the case that the number of droplets to be shot onto each pixel is four or five, each scanning operation is assigned by employing either of two processes as noted below.

4-1) As show in FIG. 8A, one of the two processes is such that each of fourth and fifth dots is assigned to first and second scanning operations.

4-2) As shown in FIG. 8B, the other process is such that in the case that the number of droplets to be shot onto each pixel is four, a scanning operation subsequent to the scanning operation having a third dot assigned thereto is assigned to a fourth dot. Additionally, in the case that the number of droplets to be shot onto each pixel is five, each of the fourth and fifth dots is assigned to the first and second scanning operations.

To form a single line, the procedure for executing the aforementioned treatments is repeated.

On the assumption that the same reference characters as those in the first embodiment of the present invention are used in order to generalize the aforementioned treatments, in the case that a pixel defined by an equation of $m=g$ is recorded on the recording paper, an extra quantity of ink droplets as represented by the residue of $g/k$ are sequentially shot onto the recording paper during the preceding scanning operation. In this connection, in the case that a pixel defined by an inequality of $k<m<g$ is recorded on the recording paper, an extra quantity of ink droplets represented by the residue of $m/k$ are sequentially shot onto the recording paper during the preceding scanning operation (i.e., treatment as mentioned in the paragraph 4-1). Otherwise, an extra quantity of ink droplets represented by the residue of $m/k$ are sequentially shot onto to the recording paper during a scanning operation different from the scanning operation having a dot located directly before the recorded dot assigned thereto (i.e., treatment as mentioned in the paragraph 4-2).

To avoid a malfunction of bleeding while the foregoing assigning process is employed for the recording apparatus, it is generally acceptable that ink is shot onto the recording paper during the preceding scanning operation. For this reason, it is preferable that the process as mentioned in the paragraph 4-1) is employed for the recording apparatus. However, to uniformalize the frequency of usage of the ejection orifices as far as possible, it is more preferable that the process as mentioned in the paragraph 4-2) is employed for the recording apparatus. It is desirable that employment of either of the treatments as mentioned in the paragraphs 4-1) and 4-2) is determined depending on the kind of ink to be used, the kind of recording paper to be used, a recording speed and available image data. In the case that the number of dots to be shot onto each pixel is four, since a malfunction of bleeding is less liable to arise, it is recommendable that the process as mentioned in the paragraph 4-2) is employed for the recording apparatus unless the recording paper exhibits particularly poor ink absorption properties.

In this embodiment, a first dot in a first line is assigned to the preceding scanning operation. Alternatively, it of course is obvious that it may be assigned to the subsequent scanning operation.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

In addition, the present invention can be applied to various serial type recording heads: a recording head fixed Lo the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system fur a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

While the present invention has been described above with respect to a few preferred embodiments thereof, it should of course be understood that the present invention should not be limited only to these embodiments but various change or modification may be made without any departure from the scope of the present invention as defined by the appended claims.

What is claimed is:

1. An ink jet apparatus using an ink jet head having a plurality of ejection portions formed thereon, said ink jet head serving to eject ink droplets from said ejection portions toward an ejection medium during a scanning operation of said ink jet head, said apparatus comprising:

a printing controlling means for forming a one line composed of a number of pixels arranged in the scanning direction with the ink droplets ejected from at least two different said ejection portions from each other among said plurality of ejection portions during each of at least two of the scanning operations of said ink jet head, said printing controlling means operating such that when a number of scanning operations required for forming said one line is k ($k \geqq 2$), a number of ink droplets which are shot onto one of said pixels is m, and a maximum value of m representing a number of ink droplets applied in a whole area of an image which is printed is g, an inequality of $k<g$ is established, and when a pixel defined by an inequality of $k<m$ is formed, an extra quantity of ink droplets represented by a residue of m/k are sequentially shot during at least one preceding said scanning operation.

2. An ink jet apparatus as claimed in claim 1, wherein when each said pixel is formed, an ink droplet which is shot first is shot during the scanning operation which is different from the scanning operation to which a last shooting of an ink droplet is assigned, said last shot ink droplet being used for a pixel formed previously just before said pixel which is now formed, and when pixels defined by an inequality of $k \geqq m$ are formed, ink droplets are shot during a scanning operation different from the scanning operation directly before a preceding said ink droplet shooting.

3. An ink jet apparatus as claimed in claim 2, wherein said ink jet head generates a bubble by utilizing thermal energy, and ejects ink as said bubble is grown.

4. An ink jet apparatus using an ink jet head having a plurality of ejection portions formed thereon, said ink jet head serving to eject ink droplets from said ejection portions toward an ejection medium during a scanning operation of said ink jet head, said apparatus comprising:

a printing controlling means for forming a one line composed of a number of pixels arranged in the scanning direction with the ink droplets ejected from at least two different said ejection portions from each other among said plurality of ejection portions during each of at least two of the scanning operations of said ink jet head, said printing controlling means operating such that when a number of scanning operations required for forming one line is k ($k \geqq 2$), a number of ink droplets which are shot onto one of said pixels is m, and a maximum value of m representing a number of ink droplets in a whole area of an image which is printed is g, an inequality of $k<g$ is established, and when a pixel defined by an equation of $m=g$ is formed, an extra quantity of ink droplets represented by a residue of g/k are sequentially shot during at least one preceding said scanning operation.

5. An ink jet apparatus as claimed in claim 4, wherein when each said pixel is formed, an ink droplet which is shot first is shot during a particular said scanning operation which is different from a later said scanning operation to which a last shooting of an ink droplet is assigned, said last shooting of the ink droplet having just been used to form a prior pixel just previous to said pixel which is now formed and when a pixel defined by an inequality of $k<m<g$ is formed, an extra quantity of ink droplets represented by a residue of m/k are sequentially shot during at least one preceding said scanning operation.

6. An ink jet apparatus as claimed in claim 4, wherein when each said pixel is formed, an ink which is shot first is shot during the scanning operation different from the scanning operation to which a last shooting of an ink droplet is assigned, said last shooting of an ink droplet being used for a pixel formed just previous to said pixel which is now formed and an extra quantity of ink droplets represented by a residue of m/k are sequentially shot during the subsequent scanning operations different from the scanning operation during which an immediately preceding said ink droplet is shot.

7. An ink jet apparatus as claimed in claim 6, wherein when said pixels defined by an inequality of $k \geqq m$ are formed, each said ink droplet is shot during the scanning operation different from the scanning operation during which an immediately preceding said ink droplet is shot.

8. An ink jet apparatus as claimed in claim 7, wherein said ink jet head generates a bubble by utilizing thermal energy, and ejects ink as said bubble is grown.

9. An ink jet apparatus using an ink jet head having a plurality of ejection portions formed thereon, said ink jet head serving to eject ink droplets from said ejection portions toward an ejection medium during a scanning operation of said ink jet head, said apparatus comprising:

a printing controlling means for forming a one line composed of a number of pixels arranged in a direction of the scanning operation of said ink jet head with the ink droplets ejected from at least two different said ejection portions from each other among said plurality of ejection portions during each of at least two of the scanning operations of said ink jet head, said print controlling means being constructed such that when a number of scanning operations required for forming said one line is k ($k \geqq 2$), a number of ink droplets which are shot onto one of said pixels is m, and a maximum value of m representing a number of ink droplets in a whole area of an image which is printed is g, an inequality of $k<g$ is established, when pixels defined by an inequality of $k<m<g$ are formed, an extra quantity of ink droplets represented by a residue of m/k are shot during the scanning operations determined corresponding to the scanning operation for ejecting those of the ink droplets other than said extra quantity of ink droplets, and in the case that pixels defined by an equation of $m=g$ are formed, an extra quantity of ink droplets defined by the residue of g/k are sequentially shot during at least one preceding said scanning operation.

10. An ink jet apparatus using an ink jet head having a plurality of ejection portions formed thereon, said ink jet head serving to eject ink droplets from said ejection portions toward an ejection medium during a scanning operation of said ink jet head, said apparatus comprising:

a transporting means for transporting the ejection medium; and a printing controlling means for forming a one line composed of a number of pixels arranged in the scanning direction with the ink droplets ejected from at least two different said ejection portions from each other among said plurality of ejection portions during each of at least two of the scanning operations of said ink jet head, said printing controlling means being constructed such that when a number of scanning operations required for forming said one line is k ($k \geqq 2$), a number of ink droplets which are shot onto one of said pixels is m, and a maximum value of m representing a number of ink droplets which are applied in a whole area of an image which is printed is g, an inequality of $k<g$ is established, and when a pixel defined by an inequality of $k<m$ is formed, an extra quantity of ink droplets represented by a residue of m/k are sequentially shot during at least one said preceding scanning operation.

11. A copying apparatus comprising:

an ink jet apparatus using an ink jet head having a plurality of ejection portions formed thereon, said ink jet head serving to eject ink droplets from said ejection portions toward an ejection medium during a scanning operation of said ink jet head, said apparatus comprising:

a printing controlling means for forming a one line composed of a number of pixels arranged in the scanning direction with the ink droplets ejected from at least two different said ejection portions from each other among said plurality of ejection portions during each of the at least two scanning operations of said ink jet head, said printing controlling means being constructed such that when a number of scanning operations required for forming said one line is k ($k \geqq 2$), a number of ink droplets which are shot onto one of said pixels is m, and a maximum value of m representing a number of ink droplets which are applied in a whole area of an image which is printed is g, an inequality of $k<g$ is established, and when a pixel defined by an inequality of $k<m$ is formed, an extra quantity of ink droplets represented by a residue of m/k are sequentially shot during at least one preceding said scanning operation.

12. A facsimile apparatus comprising:

an ink jet apparatus using an ink jet head having a plurality of ejection portions formed thereon, said ink jet head serving to eject ink droplets from said ejection portions toward an ejection medium during a scanning operation of said ink jet head, said apparatus comprising:

a printing controlling means for forming a one line composed of a number of pixels arranged in the scanning direction with the ink droplets ejected from at least two different said ejection portions from each other among said plurality of election portions during each of at least two of the scanning operations of said ink jet head, said printing controlling means being constructed such that a number of scanning operations required for forming said one line is k ($k \geqq 2$), a number of ink droplets which are shot onto one of said pixels is m, and a maximum value of m representing a number of ink droplets which are applied in a whole area of an image which is printed is g, an inequality of $k<g$ is established, and when a pixel defined by an inequality of $k<m$ is formed, an extra quantity of ink droplets represented by a residue of m/k are sequentially shot during at least one preceding said scanning operation.

13. A terminal apparatus of a computer comprising:

an ink jet apparatus using an ink jet head having a plurality of ejection portions formed thereon, said ink jet head serving to eject ink droplets from said ejection portions toward an ejection medium during a scanning operation of said ink jet head, said apparatus comprising;

a printing controlling means for forming a one line composed of a number of pixels arranged in the scanning direction with the ink droplets ejected from at least two different said ejection portions from each other among said plurality of ejection portions during each of at least two of the scanning operations of said ink jet head, said printing controlling means being constructed such that when a number of scanning operations required for forming said one line is k ($k \geqq 2$), a number of ink droplets which are shot onto one of said pixels is m, and a maximum value of m representing a number of ink droplets which are applied in a whole area of an image which is printed is g, an inequality of $k<g$ is established, and when a pixel defined by an inequality of $k<m$ is formed, an extra quantity of ink droplets represented by a residue of m/k are sequentially shot during at least one preceding said scanning operation.

14. An ink jet apparatus using an ink jet head having a plurality of ejection portions formed thereon, said ink jet head serving to eject ink droplets from said ejection portions toward an ejection medium during a scanning operation of said ink jet head, said apparatus comprising:

a transporting means for transporting the ejection medium; and a printing controlling means for forming a one line composed of a number of pixels arranged in the scanning direction with the ink droplets ejected from at least two different said ejection portions from each other among said plurality of ejection portions during each of at least two of the scanning operations of said ink jet head, said printing controlling means being constructed such that when a number of scanning operations required for forming the one line is k ($k \geqq 2$), a number of ink droplets which are shot onto one of said pixels is m, and a maximum value of m representing a number of ink droplets in a whole area of an image which is printed is g, an inequality of $k<g$ is established, and when a pixel defined by an equation of $m=g$ is formed, an extra quantity of ink droplets represented by a residue of g/k are sequentially shot during at least one preceding said scanning operation.

15. A copying apparatus comprising:

an ink jet apparatus using an ink jet head having a plurality of ejection portions formed thereon, said ink jet head serving to eject ink droplets from said ejection portions toward an ejection medium during a scanning operation of said ink jet head, said apparatus comprising;

a printing controlling means for forming a one line composed of a number of pixels arranged in the scanning direction with the ink droplets ejected from at least two different said ejection portions from each other among said plurality of ejection portions during each of at least two of the scanning operations of said ink jet head, said printing controlling means being constructed such that when a number of scanning operations required for forming the one line is k ($k \geqq 2$), a number of ink droplets which are shot onto one of said pixels is m, and a maximum value of m representing a number of ink droplets in a whole area of an image which is printed is g, an inequality of $k<g$ is established, and when a pixel defined by an equation of $m=g$ is formed, an extra quantity of ink droplets represented by a residue of g/k are sequentially shot during at least one preceding said scanning operation.

16. A facsimile apparatus comprising:

an ink jet apparatus using an ink jet head having a plurality of ejection portions formed thereon, said ink jet head serving to eject ink droplets from said ejection portions toward an ejection medium during a scanning operation of said ink jet head, said apparatus comprising;

a printing controlling means for forming a one line composed of a number of pixels arranged in the scanning direction with the ink droplets ejected from at least two different said ejection portions from each other among said plurality of ejection portions during each of at least two of the scanning operations of said ink jet head, said printing controlling means being constructed such that when a number of scanning operations required for forming the one line is k ($k \geqq 2$), a number of ink droplets which are shot onto one of said pixels is m, and a maximum value of m representing a number of ink droplets which are applied in a whole area of an image which is printed is g, an inequality of $k<g$ is established, and when a pixel defined by an equation of $m=g$ is formed, an extra quantity of ink droplets represented by a residue of g/k are sequentially shot during at least one preceding said scanning operation.

17. A terminal apparatus of a computer comprising:

an ink jet apparatus using an ink jet head having a plurality of ejection portions formed thereon, said ink jet head serving to eject ink droplets from said ejection portions toward an ejection medium during a scanning operation of said ink jet head, said apparatus comprising;

a printing controlling means for forming a one line composed of a number of pixels arranged in the scanning direction with the ink droplets ejected from at least two different said ejection portions from each other among said plurality of ejection portions during each of at least two of the scanning operations of said ink jet head, said printing controlling means being constructed such that when a number of scanning operations required for forming the one line is k ($k \geqq 2$), a number of ink droplets which are shot onto one of said pixels is m, and a maximum value of m representing a number of ink droplets which are applied in a whole area of an image which is printed is g, an inequality of $k<g$ is established, and when a pixel defined by an equation of m=g is formed, an extra quantity of ink droplets represented by a residue of g/k are sequentially shot during at least one preceding said scanning operation.

18. An ink jet apparatus using an ink jet head having a plurality of ejection portions formed thereon, said ink jet head serving to eject ink droplets from said ejection portions toward an ejection medium during a scanning operation of said ink jet head, said apparatus comprising:

a transporting means for transporting the ejection medium; and a printing controlling means for forming a one line composed of a number of pixels arranged in the scanning direction with the ink droplets ejected from at least two different said ejection portions from each other among said plurality of ejection portions during each of at least two of the scanning operations of said ink jet head, said print controlling means being constructed such that when a number of scanning operations required for forming said one line is k ($k \geqq 2$), a number of ink droplets which are shot onto one of said pixels is m, and a maximum value of m representing a number of ink droplets which are applied in a whole area of an image which is printed is g, an inequality of $k<g$ is established, when pixels defined by an inequality of $k<m<g$ are formed, an extra quantity of ink droplets represented by a residue of m/k are shot during the scanning operations determined corresponding to the scanning operation for ejecting those of the ink droplets other than said extra quantity of ink droplets, and when pixels defined by an equation of m=g are formed, an extra quantity of ink droplets defined by the residue of g/k are sequentially shot during at least one preceding said scanning operation.

19. A copying apparatus comprising:

an ink jet apparatus using an ink jet head having a plurality of ejection portions formed thereon, said ink jet head serving to eject ink droplets from said ejection portions toward an ejection medium during a scanning operation of said ink jet head, said apparatus comprising;

a printing controlling means for forming a one line composed of a number of pixels arranged in the scanning direction with the ink droplets ejected from at least two different said ejection portions from each other among said plurality of ejection portions during each of at least two of the scanning operations of said ink jet head, said print controlling means being constructed such that when number of scanning operations required for forming said one line is k ($k \geqq 2$), a number of ink droplets which are shot onto one of said pixels is m, and a maximum value of m representing a number of ink droplets which are applied in a whole area of an image which is printed is g, an inequality of $k<g$ is established, when pixels defined by an inequality of $k<m<g$ are formed, an extra quantity of ink droplets represented by a residue of m/k are shot during the scanning operations determined corresponding to the scanning operation for ejecting those of the ink droplets other than said extra quantity of ink droplets, and when pixels defined by an equation of m=g are formed, an extra quantity of ink droplets defined by the residue of g/k are sequentially shot during at least one preceding said scanning operation.

20. A facsimile apparatus comprising:

an ink jet apparatus using an ink jet head having a plurality of ejection portions formed thereon, said ink jet head serving to eject ink droplets from said ejection portions toward an ejection medium during a scanning operation of said ink jet head, said apparatus comprising;

a printing controlling means for forming a one line composed of a number of pixels arranged in the scanning direction with the ink droplets ejected from at least two different said ejection portions from each other among said plurality of ejection portions during each of at least two of the scanning operations of said ink jet head, said print controlling means being constructed such that when a number of scanning operations required for forming said one line is k ($k \geqq 2$), a number of ink droplets which are shot onto one of said pixels is m, and a maximum value of m representing a number of ink droplets which are applied in a whole area of an image which is printed is g, an inequality of $k<g$ is established, when pixels defined by an inequality of $k<m<g$ are formed, an extra quantity of ink droplets represented by a residue of m/k are shot during the scanning operations determined corresponding to the scanning operation for ejecting those of the ink droplets other than said extra quantity of ink droplets, and when pixels defined by an equation of m=g are formed, an extra quantity of ink droplets defined by the residue of g/k are sequentially shot during at least one preceding said scanning operation.

21. A terminal apparatus of a computer comprising:

an ink jet apparatus using an ink jet head having a plurality of ejection portions formed thereon, said ink jet head serving to eject ink droplets from said ejection portions toward an ejection medium during a scanning operation of said ink jet head, said apparatus comprising;

a printing controlling means for forming a one line composed of a number of pixels arranged in the scanning direction with the ink droplets ejected from at least two different said ejection portions from each other among said plurality of ejection portions during each of at least two of the scanning operations of said ink jet head, said print controlling means being constructed such that when a number of scanning operations required for forming said one line is k ($k \geqq 2$), a number of ink droplets which are shot onto one of said pixels is m, and a maximum value of m representing a number of ink droplets which are applied in a whole area of an image which is printed is g, an inequality of $k<g$ is established, when pixels defined by an inequality of $k<m<g$ are formed, an extra quantity of ink droplets represented by a residue of m/k are shot during the scanning operations determined corresponding to the scanning operation for ejecting those of the ink droplets other than said extra quantity of ink droplets, and when pixels defined by an equation of m=g are formed, an extra quantity of ink droplets defined by the residue of g/k are sequentially shot during at least one preceding said scanning operation.

* * * * *

UNITED STATES PATENT AND TRADEMARK OFFICE

CERTIFICATE OF CORRECTION

PATENT NO. : 5,933,162

DATED : August 3, 1999

INVENTOR(S) : Makoto Shioya

It is certified that error appears in the above-identified patent and that said Letters Patent is hereby corrected as shown below:

COLUMN 4:

Line 58, "he" should read --be--.

COLUMN 5:

Line 29, "th" should read --the--.

COLUMN 6:

Line 59, "FIG. 6 a" should read --FIG. 6 is a--.

COLUMN 8:

Line 6, "kind" should read --kinds--.

Line 11, "date" should read --data--.

COLUMN 9:

Line 7, "(step" should read --(Step--.

UNITED STATES PATENT AND TRADEMARK OFFICE

CERTIFICATE OF CORRECTION

PATENT NO. : 5,933,162

DATED : August 3, 1999

INVENTOR(S) : Makoto Shioya

It is certified that error appears in the above-identified patent and that said Letters Patent is hereby corrected as shown below:

COLUMN 11:

Line 6, "a rise" should read --arise--.

COLUMN 13:

Line 18, "Lo" should read --to--.

Signed and Sealed this

Sixteenth Day of May, 2000

*Attest:*

Q. TODD DICKINSON

*Attesting Officer*

*Director of Patents and Trademarks*